US008937520B2

(12) United States Patent
Kan

(10) Patent No.: US 8,937,520 B2
(45) Date of Patent: Jan. 20, 2015

(54) MAGNETIC KEYSWITCH ASSEMBLY AND KEYBOARD THEREWITH

(71) Applicant: Darfon Electronics Corp., Taoyuan (TW)

(72) Inventor: Chen-Hao Kan, Taoyuan (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 42 days.

(21) Appl. No.: 13/776,672

(22) Filed: Feb. 25, 2013

(65) Prior Publication Data

US 2013/0249658 A1 Sep. 26, 2013

(30) Foreign Application Priority Data

Mar. 22, 2012 (TW) ..... 101205132 U

(51) Int. Cl.

| | |
|---|---|
| ***H01H 9/00*** | (2006.01) |
| ***H01H 36/00*** | (2006.01) |
| ***H01H 13/85*** | (2006.01) |
| *H01H 5/02* | (2006.01) |

(52) U.S. Cl.

CPC ..... *H01H 36/00* (2013.01); *H01H 13/85* (2013.01); *H01H 5/02* (2013.01); *H01H 2215/042* (2013.01); *H01H 2221/016* (2013.01); *H01H 2221/04* (2013.01)

USPC ..... 335/205

(58) Field of Classification Search

USPC ..... 335/205–207

See application file for complete search history.

(56) References Cited

U.S. PATENT DOCUMENTS 5,977,888 A * 11/1999 Fujita et al. ..... 341/34
6,670,873 B2 12/2003 Inada

* cited by examiner

*Primary Examiner* — Ramon Barrera
(74) *Attorney, Agent, or Firm* — Winston Hsu; Scott Margo

(57) ABSTRACT

A magnetic keyswitch assembly includes a movable keycap, a support plate, a magnetic element, a frame and a switch component. The movable keycap includes a pivot and a metal part. The support plate supports the pivot. The magnetic element attracts the metal part, and a direction of a magnetic attractive force between the magnetic element and the metal part is perpendicular to a movement direction of the movable keycap. The frame is for accommodating the magnetic element. The switch component is disposed beneath the movable keycap. The magnetic element attracts the metal part so as to make the switch component in an OFF state as the movable keycap is undepressed. The movable keycap moves downward to trigger the switch component as the movable keycap is depressed to exceed a force threshold.

2 Claims, 2 Drawing Sheets

MAGNETIC KEYSWITCH ASSEMBLY AND KEYBOARD THEREWITH

BACKGROUND OF THE INVENTION

1. Field of the Invention

The present invention relates to a magnetic keyswitch assembly and a keyboard therewith, and more specifically, to a magnetic keyswitch assembly and a keyboard therewith capable of recovering a keycap by magnetic force wherein a direction of magnetic force to attract or exclude the keycap by a magnetic element is perpendicular to a movement direction of the keycap.

2. Description of the Prior Art

Since modern technology trends to small size and light weight, a notebook computer has been more and more popular in computer industry. Accordingly, a keyboard equipped for the notebook computer also trends to thin size. There are many kinds of mechanical design of the keyboard in the market. For example, Taiwan patent no. M416801 and U.S. Pat. No. 4,453,148 disclose keyboards with magnetic components. Alternatively, an elastic component, such as a rubber dome, is often disposed inside a convention keyswitch for not only recovering a keycap as the keycap is undepressed but also providing a tactile sensation to a user at timing maintaining an operation feeling of the user. However, it is needed to reserve more mechanical space for the conventional elastic component with larger height, resulting in disadvantage to the recent trend of thin and small size of the notebook computer.

SUMMARY OF THE INVENTION

The present invention provides a magnetic keyswitch assembly and a keyboard therewith with reduced height.

For achieving the above-mentioned purpose, the present invention provides a keyswitch assembly capable of recovering a keycap by magnetic force.

For achieving the above-mentioned purpose, the present invention further provides a keyswitch assembly capable of providing a tactile sensation similar to a rubber dome by magnetic attractive force or magnetic repulsive force.

According to an embodiment of the present invention, a magnetic keyswitch assembly includes a movable keycap, a support plate, a magnetic element, a frame and a switch component. The movable keycap includes a pivot and a metal part. The movable keycap selectively rotates relative to the pivot. The support plate supports the pivot. The magnetic element attracts the metal part, and a direction of a magnetic attractive force between the magnetic element and the metal part is perpendicular to a movement direction of the movable keycap. The frame is for accommodating the magnetic element. The switch component is disposed beneath the movable keycap. The magnetic element attracts the metal part so as to make the switch component in an OFF state as the movable keycap is undepressed. The movable keycap moves downward to trigger the switch component as the movable keycap is depressed to exceed a force threshold.

According to another embodiment of the present invention, a magnetic keyswitch assembly includes a movable keycap. The movable keycap includes a pivot and a first magnetic element. The movable keycap selectively rotates relative to the pivot. The magnetic keyswitch assembly further includes a second magnetic element for attracting the first magnetic element. A direction of a magnetic attractive force between the second magnetic element and the first magnetic element is perpendicular to a movement direction of the movable keycap. The magnetic keyswitch assembly further includes a frame for accommodating the second magnetic element, and a switch component disposed beneath the movable keycap. The second magnetic element attracts the first magnetic element so as to make the switch component in an OFF state as the movable keycap is undepressed, and the movable keycap moves downward to trigger the switch component as the movable keycap is depressed to exceed a force threshold.

According to another embodiment of the present invention, a magnetic keyswitch assembly includes a movable keycap with a pivot and a first magnetic element. The movable keycap selectively rotates relative to the pivot. The magnetic keyswitch assembly further includes a second magnetic element for excluding the first magnetic element. A direction of a magnetic repulsive force between the second magnetic element and the first magnetic element is perpendicular to a movement direction of the movable keycap. The magnetic keyswitch assembly further includes a support plate for supporting the pivot and accommodating the second magnetic element, and a switch component disposed beneath the movable keycap. The first magnetic element excludes the second magnetic element so as to make the switch component in an OFF state as the movable keycap is undepressed, and the movable keycap moves downward to trigger the switch component as the movable keycap is depressed to exceed a force threshold.

These and other objectives of the present invention will no doubt become obvious to those of ordinary skill in the art after reading the following detailed description of the embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
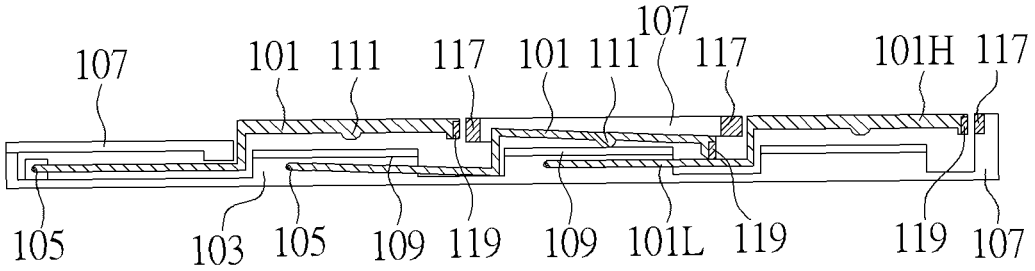
FIG. 1 is a diagram of a keyboard with three magnetic keyswitch assemblies according to a first embodiment of the present invention.

Please refer to FIG. 1. FIG. 1 is a diagram of a keyboard with three magnetic keyswitch assemblies according to a first embodiment of the present invention. As shown in FIG. 1, the left and right magnetic keyswitch assemblies are undepressed in an initial condition. The middle magnetic keyswitch assembly is depressed downward. In the first embodiment, the magnetic keyswitch assembly includes a movable keycap 101 capable of moving upward and downward, a support plate 103, a frame 107 and a switch component 109. The movable keycap 101 includes a pivot 105 and a magnetic element 117, and the movable keycap 101 selectively rotates relative to the pivot 105. The support plate 103 supports the pivot 105. The frame 107 has inner space for accommodating the magnetic element 117. The movable keycap 101 includes a metal part 119 capable of being attracted by the magnetic element 117. The movable keycap 101 can be a ladder-shaped structure. The movable keycap 101 includes a first portion 101H and a second portion 101L. The first portion 101H is for a user to press for triggering the switch component 109. The metal part 119 is disposed on an end of the first portion 101H. The pivot 105 is disposed on an end of the second portion 101H.

The magnetic element 117 is for attracting the metal part 119 disposed on the end of the first portion 101H of the movable keycap 101, and a direction of a magnetic attractive force between the magnetic element 117 and the metal part 119 is perpendicular to a movement direction of the movable keycap 101. The switch component 109 is disposed beneath the movable keycap 101. The magnetic element 117 attracts the metal part 119 so as to make the switch component 109 in an OFF state as the movable keycap 101 is undepressed, such as the left and right magnetic keyswitch assemblies being undepressed in the initial condition. The movable keycap 101 moves downward to trigger the switch component 109, as the movable keycap 101 is depressed to exceed a force threshold for overcoming the magnetic attractive force between the magnetic element 117 and the metal part 119 so that the metal part 119 of the movable keycap 101 can separate from the magnetic element 117, such as the middle magnetic keyswitch assembly being depressed downward. It also can provide a tactile sensation for the user to be aware that the switch component 109 has been triggered. A protrusion 111 can be formed on a lower surface of the movable keycap 101 for triggering the switch component 109. The switch component 109 can be a membrane switch. The movable keycap 101 can be made of plastic material. The movable keycap 101 and the metal part 119 can be combined in an insert molding method.

Figure 2:
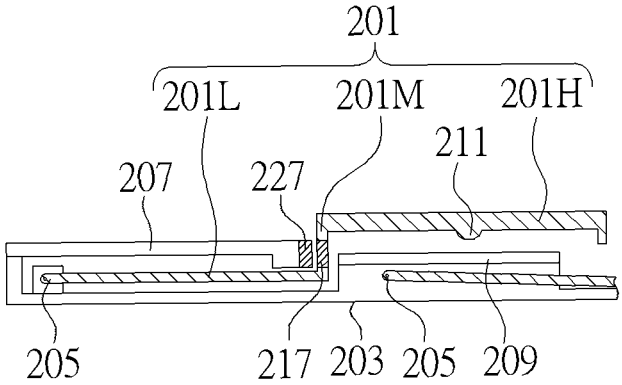
FIG. 2 is a diagram of a keyboard with a magnetic keyswitch assembly according to a second embodiment of the present invention.

Please refer to FIG. 2. FIG. 2 is a diagram of a keyboard with a magnetic keyswitch assembly according to a second embodiment of the present invention. As shown in FIG. 2, for simplicity, it is only illustrated one set of the magnetic keyswitch assembly being undepressed in an initial condition, and a frame of the keyboard is omitted. In the second embodiment, the magnetic keyswitch assembly includes a movable keycap 201 capable of moving upward and downward, a support plate 203, a frame 207 and a switch component 209. The movable keycap 201 includes a pivot 205 and a first magnetic element 217, and the movable keycap 201 selectively rotates relative to the pivot 205. The support plate 203 supports the pivot 205. The magnetic keyswitch assembly further includes a second magnetic element 227 for attracting the first magnetic element 217. The frame 207 has inner space for accommodating the second magnetic element 227. The movable keycap 201 can be a ladder-shaped structure. The movable keycap 201 includes a first portion 201H, a connecting portion 201M and a second portion 201L. The first portion 201H is for a user to press for triggering the switch component 209. The connecting portion 201M is connected to the first portion 201H and the second portion 201L, and the first magnetic element 217 is disposed on the connecting portion 201M. The pivot 205 is disposed on an end of the second portion 201L.

The second magnetic element 227 is for attracting the first magnetic element 217, and a direction of a magnetic attractive force between the first magnetic element 217 and the second magnetic element 227 is perpendicular to a movement direction of the movable keycap 201. The switch component 209 is disposed beneath the movable keycap 201. The first magnetic element 217 attracts the second magnetic element 227 so as to make the switch component 209 in an OFF state as the movable keycap 201 is undepressed. The movable keycap 201 moves downward to trigger the switch component 209, as the movable keycap 201 is depressed to exceed a force threshold for overcoming the magnetic attractive force between the first magnetic element 217 and the second magnetic element 227. It also can provide a tactile sensation for the user to be aware that the switch component 209 has been triggered. A protrusion 211 can be formed on a lower surface of the movable keycap 201 for triggering the switch component 209. The switch component 209 can be a membrane switch. The first magnetic element 217 and the second magnetic element 227 can be an iron element or a magnet alternatively. The mechanism for generating the magnetic attractive force between the first magnetic element 217 and the second magnetic element 227 is within the scope of the present invention. The movable keycap 201 can be made of plastic material. The movable keycap 201 and the first magnetic element 217 can be combined in an insert molding method. Similarly, the frame 207 can be made of plastic material, and the frame 207 and the second magnetic element 227 can be combined in an insert molding method.

Figure 3:
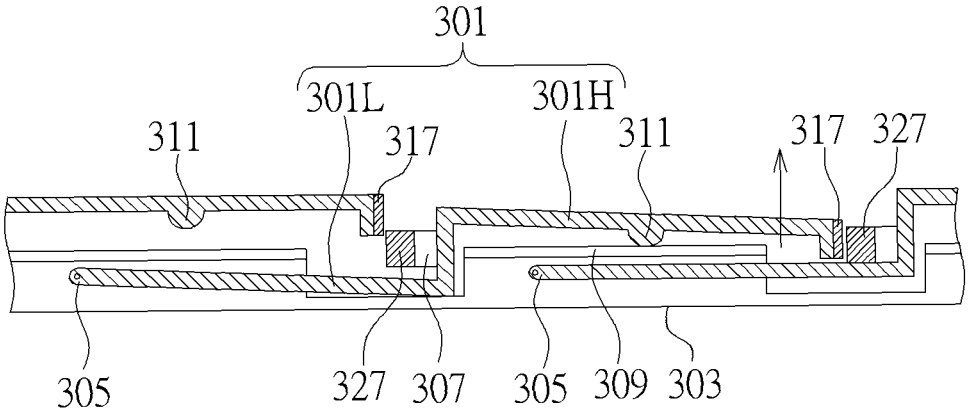
FIG. 3 is a diagram of a keyboard with two magnetic keyswitch assemblies according to a third embodiment of the present invention.

Please refer to FIG. 3. FIG. 3 is a diagram of a keyboard with two magnetic keyswitch assemblies according to a third embodiment of the present invention. As shown in FIG. 3, the left magnetic keyswitch assembly is undepressed in an initial condition. The right magnetic keyswitch assembly is depressed downward. In the third embodiment, the magnetic keyswitch assembly includes a movable keycap 301 capable of moving upward and downward, a support plate 303, a frame 307 and a switch component 309. The movable keycap 301 includes a pivot 305 and a first magnetic element 317, and the movable keycap 301 selectively rotates relative to the pivot 305. The support plate 303 supports the pivot 305. The magnetic keyswitch assembly further includes a second magnetic element 327 for excluding the first magnetic element 317. The support plate 303 has inner space for accommodating the second magnetic element 327. The movable keycap 301 can be a ladder-shaped structure. The movable keycap 301 includes a first portion 301H and a second portion 301L. The first portion 301H is for a user to press for triggering the switch component 309. The switch component 309 can be a membrane switch. The first magnetic element 317 is disposed on the first portion 301H. The pivot 305 is disposed on an end of the second portion 301L.

The second magnetic element 327 is for excluding the first magnetic element 317, and a direction of a magnetic repulsive force between the first magnetic element 317 and the second magnetic element 327 is perpendicular to a movement direction of the movable keycap 301. The first magnetic element 317 and the second magnetic element 327 can be magnets. The switch component 309 is disposed beneath the movable keycap 301. The first magnetic element 317 excludes the second magnetic element 327 so as to make the switch component 309 in an OFF state as the movable keycap 301 is undepressed. The movable keycap 301 moves downward to trigger the switch component 309, as the movable keycap 301 is depressed to exceed a force threshold for overcoming the magnetic repulsive force between the first magnetic element 317 and the second magnetic element 327. It also can provide a tactile sensation for the user to be aware that the switch component 309 has been triggered. A protrusion 311 can be formed on a lower surface of the movable keycap 301 for triggering the switch component 309. As the movable keycap 301 is undepressed, the magnetic repulsive force between the first magnetic element 317 and the second magnetic element 327 recovers the movable keycap 301 upward in an arrow direction as shown in FIG. 3.

Figure 4:
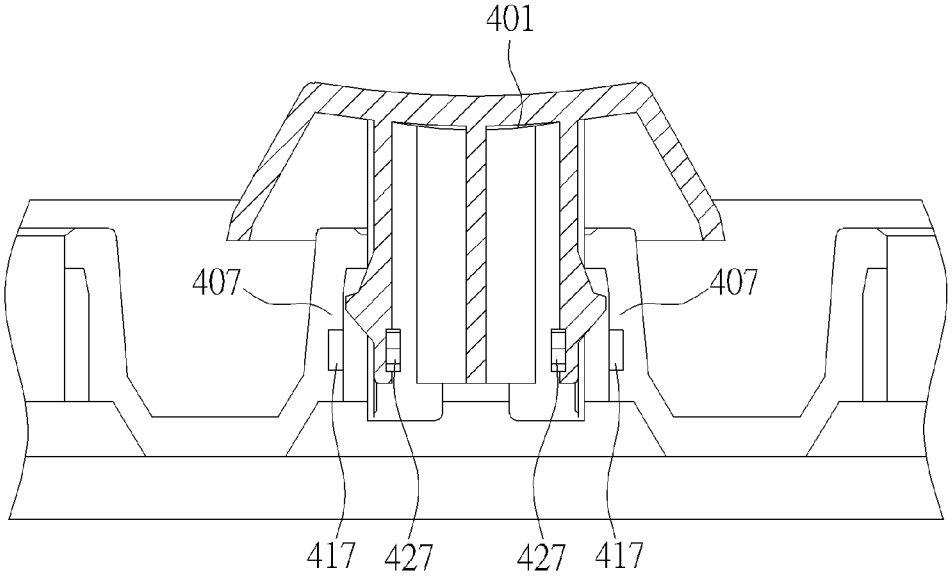
FIG. 4 is a diagram of a keyboard with a magnetic keyswitch assembly according to a fourth embodiment of the present invention.

Please refer to FIG. 4. FIG. 4 is a diagram of a keyboard with a magnetic keyswitch assembly according to a fourth embodiment of the present invention. In the fourth embodiment, the magnetic keyswitch assembly includes a movable keycap 401 capable of moving upward and downward. The movable keycap 401 includes a plunger 409. The magnetic keyswitch assembly further includes at least one first magnetic element 417 disposed on a lateral side of the plunger 409, a frame 407 for accommodating the plunger 409 to move upward and downward, and at least one second magnetic element 427 disposed inside the frame 407 for attracting the at least one first magnetic element 417. A direction of a magnetic attractive force between the at least one second magnetic element 427 and the at least one first magnetic element 417 is perpendicular to a movement direction of the movable keycap 401. The magnetic keyswitch assembly further includes a switch component (not shown in Figure) disposed beneath the plunger 409. The first magnetic element 417 attracts the second magnetic element 427 so as to make the switch component in an OFF state as the movable keycap 401 is undepressed. The plunger 409 moves downward to trigger the switch component, as the movable keycap 401 is depressed to exceed a force threshold for overcoming the magnetic attractive force between the first magnetic element 417 and the second magnetic element 427. It also can provide a tactile sensation for the user to be aware that the switch component has been triggered.

Figure 5:
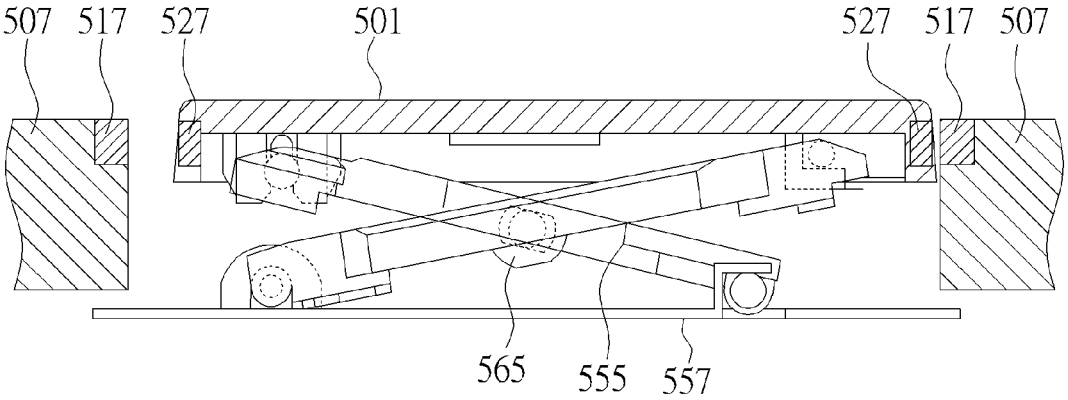
FIG. 5 is a diagram of a keyboard with a magnetic keyswitch assembly according to a fifth embodiment of the present invention.

Please refer to FIG. 5. FIG. 5 is a diagram of a keyboard with a magnetic keyswitch assembly according to a fifth embodiment of the present invention. In the fifth embodiment, the magnetic keyswitch assembly includes a base plate 557, a movable keycap 501 capable of moving upward and downward, and a scissors-type connecting member 555 movably installed on the base plate 557 and connected to the movable keycap 501. The scissors-type connecting member 555 is for driving the movable keycap 501 upward or downward relative to the base plate 557. The scissors-type connecting member 555 includes an actuating portion 565. The magnetic keyswitch assembly further includes at least one first magnetic element 517 disposed on a lateral side of the movable keycap 501, a frame 507, and at least one second magnetic element 527 disposed on the frame 507 for attracting the at least one first magnetic element 517. A direction of a magnetic attractive force between the at least one second magnetic element 527 and the at least one first magnetic element 517 is perpendicular to a movement direction of the movable keycap 501. The magnetic keyswitch assembly further includes a switch component (not shown in Figure) disposed on the base plate 557. The first magnetic element 517 attracts the second magnetic element 527 so as to make the switch component in an OFF state as the movable keycap 501 is undepressed. The actuating portion 565 moves downward to trigger the switch component, as the movable keycap 501 is depressed to exceed a force threshold for overcoming the magnetic attractive force between the first magnetic element 517 and the second magnetic element 527. It also can provide a tactile sensation for the user to be aware that the switch component has been triggered.

In another embodiment of the present invention, a keyboard can include different combinations of the above-mentioned magnetic keyswitch assemblies.

In contrast with the prior art, the present invention provides the magnetic keyswitch assembly and the keyboard therewith capable of recovering the keycap by magnetic force. It should be noticed that the direction of magnetic force to attract or exclude the keycap is perpendicular to the movement direction of the keycap. It can reserve mechanical space for the magnetic keyswitch assembly, which meets the recent trend of thin and small size of the notebook computer.

Those skilled in the art will readily observe that numerous modifications and alterations of the device and method may be made while retaining the teachings of the invention.

What is claimed is:

1. A magnetic keyswitch assembly comprising:

a movable keycap comprising a pivot and a first magnetic element, the movable keycap being for selectively rotating relative to the pivot, the movable keycap being a ladder-shaped structure;

a second magnetic element for attracting the first magnetic element, a direction of a magnetic attractive force between the second magnetic element and the first magnetic element being perpendicular to a movement direction of the movable keycap;

a frame for accommodating the second magnetic element; and a switch component disposed beneath the movable keycap, the second magnetic element attracting the first magnetic element so as to make the switch component in an OFF state as the movable keycap is undepressed, and the movable keycap moving downward to trigger the switch component as the movable keycap is depressed to exceed a force threshold;

wherein the movable keycap comprises:

a first portion for triggering the switch component;

a second portion, the pivot being disposed on an end of the second portion; and a connecting portion connected to the first portion and the second portion, the first magnetic element being disposed on the connecting portion.

2. The magnetic keyswitch assembly of claim 1, wherein the first magnetic element is disposed at a position on the connecting portion facing the second magnetic element on the frame.

* * * * *